US005984974A

United States Patent [19]

Shibata et al.

[11] Patent Number: 5,984,974

[45] Date of Patent: Nov. 16, 1999

[54] PROCESS FOR PRODUCING A SILK FIBROIN MODIFIED WOOLEN FIBER AND A MODIFIED WOOLEN FIBER

[75] Inventors: Kiyohiro Shibata, Osaka-fu; Toru Itoi, 861-11 Komatsuri-cho, Osaka-fu 596-0000, both of Japan

[73] Assignees: Toa Wool Spinning & Weaving Co., Ltd.; Toru Itoi, both of Osaka, Japan

[21] Appl. No.: 09/244,901

[22] Filed: Feb. 4, 1999

[30] Foreign Application Priority Data

Mar. 2, 1998 [JP] Japan ..... 10-049766

[51] Int. Cl.[6] ..... D06M 15/15; D06M 101/12

[52] U.S. Cl. ..... 8/128.1

[58] Field of Search ..... 8/128.1, 128.3; 106/124.1; 162/151, 164.1, 174

[56] References Cited

U.S. PATENT DOCUMENTS

| | | | |
|---|---|---|---|
| 2,373,974 | 4/1945 | Phillips et al. | 8/128.1 |
| 3,952,581 | 4/1976 | Schafer et al. | 427/377 |
| 4,075,177 | 2/1978 | Bonnet et al. | 8/127.6 |
| 4,248,596 | 2/1981 | Schafer | 8/127.6 |
| 4,835,803 | 6/1989 | Mizuahima | 8/128.1 |
| 4,985,040 | 1/1991 | Heywood et al. | 8/128.1 |

FOREIGN PATENT DOCUMENTS

| | | |
|---|---|---|
| 4-100976 | 4/1992 | Japan . |
| 7-258973 | 10/1995 | Japan . |
| 7-300772 | 11/1995 | Japan . |
| 8-003875 | 1/1996 | Japan . |

OTHER PUBLICATIONS

English language translation of Kanebo, JP 4–100,976, pp. 1–22, Apr. 1992.

CAPLUS Abstract of JP 6–036,762, Kanebo Ltd, Nov. 1994.

CAPLUS Absract of JP 1–280,074, Daito Woolen Spinning and Weaving Co., Nov. 1989.

CAPLUS Abstract of JP 62–062,990, Mizushima et al., Mar. 1987.

CAPLUS Abstract, Owari Text. Res. Inst., "Wool Treatment by Natural Polymer," Senshoku Kogyo, 1995 (no month available).

*Primary Examiner*—Caroline D. Liott

*Attorney, Agent, or Firm*—Kanesaka & Takeuchi

[57] ABSTRACT

To provide gloss to a woolen fiber by adhering silk fibroin to the woolen fiber firmly and uniformly, a woven woolen fiber subjected to anionic processing is infiltrated with a silk fibroin solution, a cationic polymer resin is dissolved in the solution, and the cationic polymer resin is ion bonded to the woolen fiber to fix silk fibroin fine particles to the woolen fiber.

4 Claims, 3 Drawing Sheets

PROCESS FOR PRODUCING A SILK FIBROIN MODIFIED WOOLEN FIBER AND A MODIFIED WOOLEN FIBER

BACKGROUND OF THE INVENTION

1. Field of the Invention

The present invention relates to a process for producing a modified woolen fiber by treating a woolen fiber with silk fibroin to modify it into a silky fiber and to a modified woolen fiber.

2. Description of the Prior Art

Heretofore, to modify a woolen fiber into a silky fiber by treating the woolen fiber with silk fibroin, for example, as shown in FIG. 4, woolen fibers 11 woven into cloth and rolled round a bobbin 12 have been treated in a bath 14 filled with a silk fibroin aqueous solution 13 containing silk fibroin dispersed therein. That is, the woolen fibers 11 have been pulled into the bath 13 by pull-in rollers 15, 16 and lifted by lifting rollers 17, 18 to pass through the silk fibroin aqueous solution 13 in the bath 14 so as to adsorb silk fibroin to the surface of each of the woolen fibers 11.

The silk fibroin aqueous solution 13 is generally prepared by hydrolyzing a silk material such as a cocoon, raw silk, cocoon flocks, raw silk flocks or the like to form a solution, drying it to form fine powders and dispersing them into water again. Silk fibroin fine particles contained in the silk fibroin aqueous solution 13 infiltrate into the woolen fibers 11 together with water by a capillary phenomenon and are adhered to the surface of each of the woolen fibers 11. After the woolen fibers 11 are immersed in the bath 14 for a predetermined time, they are lifted and dried with a hot air drier or the like.

FIG. 1(*b*) is a diagram of the woolen fiber 11 treated with the above silk fibroin, which shows that silk fibroin fine particles S are separated from one another and sparsely adhered to the surface of each of the woolen fibers. Since the above woolen fibers treated with silk fibroin have a silky feeling and gloss and are inexpensive, they are used in various kinds of fabrics.

However, the silk fibroin treatment of the prior art has such problems as fluctuations in the degree of processing due to lack of uniformity in squeezing and lack of uniformity in dyeing which occurs at the time of dyeing because the silk fibroin fine particles are sparsely and nonuniformly adhered to the surface of the woolen fiber. Since the silk fibroin is physically adhered to the surface of the woolen fiber, the adhesion strength of the silk fibroin is insufficient and the durability thereof is low. Therefore, the adhered silk fibroin falls off from the woolen fiber and the silky feeling and gloss of the woolen fiber are lost when a fabric woven of the woolen fibers is used and washed repeatedly.

To cope with this, there is proposed a technology for improving the adhesion strength of silk fibroin to a woolen fiber by carrying out a silk fibroin treatment using a cation modified silk fibroin solution (Japanese Laid-open Patent Application No. 4-100976). However, as silk fibroin itself is hardly ionized, the adhesion of the silk fibroin is not so improved by carrying out a silk fibroin treatment using the above solution and sufficiently high durability cannot be obtained.

Since the silk fibroin treatment is made on a cloth woven of the woolen fibers, the silk fibroin is not uniformly adhered to the cloth. Therefore, the adhesion of the silk fibroin easily becomes nonuniform.

SUMMARY OF THE INVENTION

It is an object of the present invention which has been made to solve the above problems to provide a modified woolen fiber having durability to which silk fibroin is firmly and uniformly adhered and a production process therefor.

According to a first aspect of the present invention, there is provided a process for producing a modified woolen fiber which comprises infiltrating a woolen fiber with a silk fibroin aqueous solution and with a cationic polymer resin to fix silk fibroin to the woolen fiber.

According to a second aspect of the present invention, there is provided a process for producing a modified woolen fiber which comprises infiltrating a woolen fiber subjected to anionic processing with a silk fibroin solution, dissolving a cationic polymer resin in the solution and ion bonding the cationic polymer resin to the woolen fiber to fix silk fibroin to the woolen fiber.

According to a third aspect of the present invention, there is provided a process for producing a modified woolen fiber which comprises infiltrating an unwoven, woven or reeled woolen fiber with silk fibroin and a cationic polymer resin.

According to a fourth aspect of the present invention, there is provided a modified woolen fiber prepared by infiltrating a woolen fiber with a silk fibroin aqueous solution and a cationic polymer resin to fix silk fibroin to the woolen fiber.

According to a fifth aspect of the present invention, there is provided a modified woolen fiber prepared by infiltrating a woolen fiber subjected to anionic processing with a silk fibroin solution, dissolving a cationic polymer resin in the solution and ion bonding the cationic polymer resin to the woolen fiber to fix silk fibroin to the woolen fiber.

According to a sixth aspect of the present invention, there is provided a modified woolen fiber prepared by infiltrating an unwoven, woven or reeled woolen fiber with silk fibroin and a cationic polymer resin to fix the silk fibroin to the woolen fiber.

The above and other objects, advantages and features of the present invention will become more apparent from the following description when taken into conjunction with the accompanying drawings.

BRIEF DESCRIPTION OF THE ACCOMPANYING DRAWINGS

FIGS. 1(*a*) and 1(*b*) are diagrams typically showing the states of a woolen fiber after a silk fibroin treatment according to an embodiment of the present invention;

FIGS. 2(*a*), 2(*b*) and 2(*c*) are diagrams typically showing the states of woolen fibers;

FIG. 3 is a diagram showing an example of a bath for carrying out a silk fibroin treatment according to an embodiment of the present invention; and FIG. 4 is a diagram for explaining the silk fibroin treatment of the prior art.

DETAILED DESCRIPTION OF THE PREFERRED EMBODIMENTS

A preferred embodiment of the present invention will be described hereinunder with reference to the accompanying drawings.

Figure 2A:
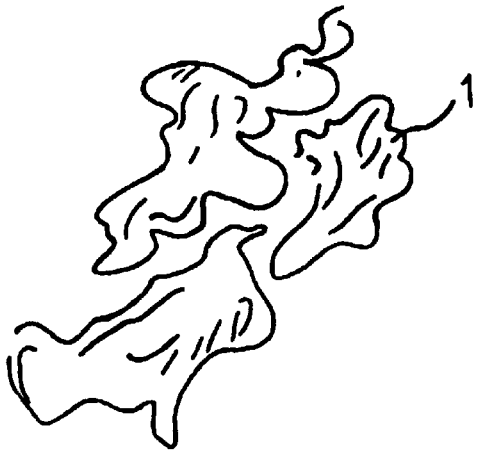
Figure 2B:
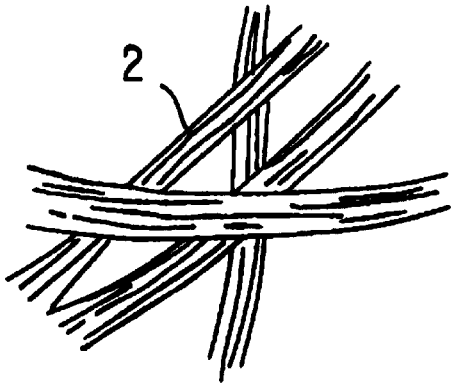
Figure 2C:
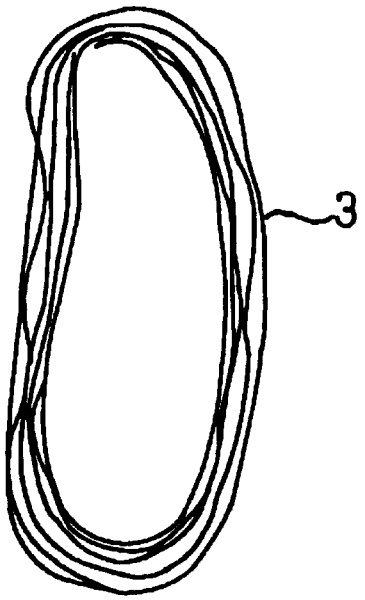

A description is first given of a woolen fiber to be treated with silk fibroin in this embodiment. FIG. 2(*a*) shows an unwoven woolen fiber 1 prepared by washing sorted raw wool to remove mutton-tallow, sweat, urine, earth and sand, and the like adhered to the raw wool and drying it. FIG. 2(*b*) shows a woven woolen fiber 2 prepared by paralleling the unwoven woolen fibers 1 and twisting these into predetermined belt-like yarn in a spinning step. FIG. 2(*c*) shows a reeled woolen fiber 3 prepared by winding single yarn or double yarn prepared in the spinning step round a bobbin called "reel" and removed from the reel. The above unwoven, woven and reeled woolen fibers 1, 2, 3 have a larger unit area per unit fiber than woolen fibers woven into cloth because the fibers are not woven with one another.

Figure 3:
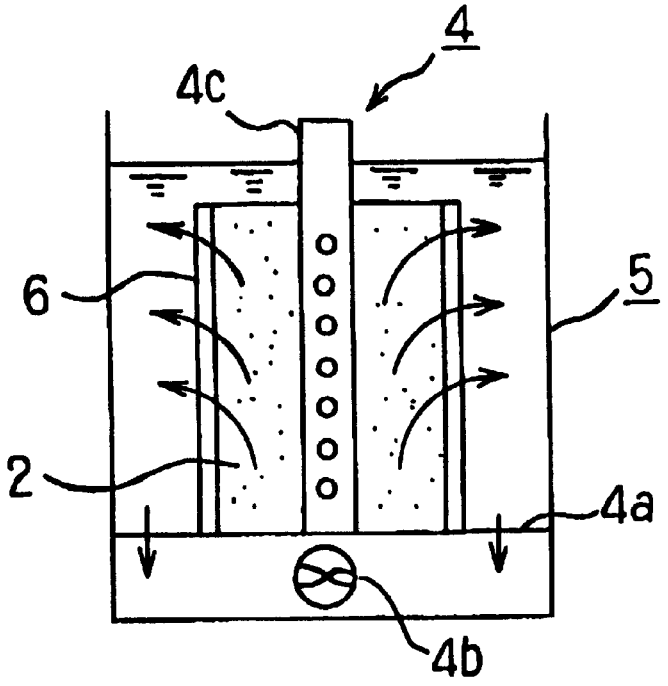
Figure 4:
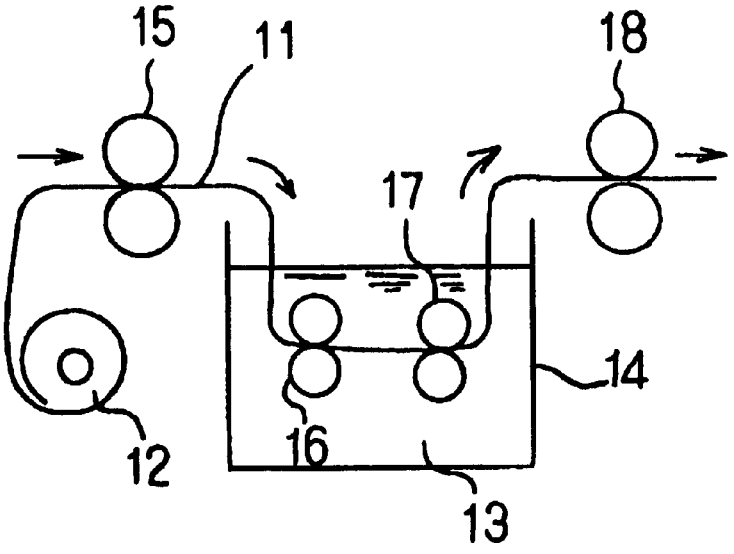
FIG. 4 PRIOR ART

A description is subsequently given of a method for treating the woven woolen fibers 2 with silk fibroin. The woven woolen fibers 2 are first subjected to anionic processing and charged into a cylindrical cage 6 having many holes and provided in a cylindrical dyeing bath 5 equipped with a circulator 4 as shown in FIG. 3. The circulator 4 has an upper bottom 4*a,* a pump 4*b* located below the upper bottom 4*a* and a cylinder 4*c* located above the upper bottom 4*a*. Many holes for circulating a solution in the dyeing bath 5 are formed in the upper bottom 4*a* and the cylinder 4*c*. The cylinder 4*c* of the circulator 4 is arranged in the center of the cage 6.

The above woolen fibers 2 are washed with water in the above dyeing bath 5 for 5 minutes. When the dyeing bath 5 is filled with water and the circulator 4 is activated, water circulates such that it rises in the cylinder 4*c* by the rotation of the pump 4*b,* goes out from the holes in the cylinder 4*c,* passes between adjacent woolen fibers 2 having a large surface area, goes to the outside of the cage 6 through the holes in the cage 6, and falls down through the holes in the upper bottom 4*a* from above. Since each of the woolen fibers 2 is woven, it has a large contact area with water and is washed efficiently. After washing, water in the dyeing bath 5 is removed, fresh water is charged into the dyeing bath 5, 0.5 wt % of a nonionic activator and 0.5 wt % of mirabilite (sodium sulfate decahydrate) are mixed together, the temperature of the mixed water is raised to 45° C. and maintained at that temperature for 15 minutes while the circulator 5 is kept in operation, and the woolen fibers 2 are swollen with the mixed water. Both the above "wt %" and the following "wt %" indicate a weight proportion of the mixture to the total weight of the woolen fibers 2 to be treated.

After swelling, the circulator 4 is stopped to remove the mixed water in the dyeing bath 5, fresh water is charged into the dyeing bath 5, 1.0 to 10.0 wt %, preferably 3.0 wt % of silk fibroin powders are dissolved in water to form an aqueous solution, and the circulator 5 is reactivated to carry out a silk fibroin infiltration treatment for 5 minutes. Since each of the woolen fibers 2 is woven, it has many openings and silk fibroin fine particles infiltrate into the interior of the woolen fiber 2 and are adhered to the woolen fiber 2 uniformly.

Thereafter, 0.5 to 0.2 wt %, preferably 1.0 wt % of a cationic polymer resin is dissolved in a similar aqueous solution and charged into the dyeing bath 5 to carry out the infiltration treatment of silk fibroin and the cationic polymer resin for 5 minutes. Since the woolen fibers 2 are subjected to anionic processing as described above, the cationic polymer resin is firmly adhered to the surface of each of the woolen fibers 2 by ion bonding. As the cationic polymer resin is adhered to the woolen fibers 2 in such a manner that silk fibroin fine particles remaining in the solution are contained therein, the amount of silk fibroin adhered to the woolen fibers 2 increases.

Thereafter, 1.0 wt % of sodium hydrogen carbonate is dissolved in a similar aqueous solution and charged into the dyeing bath 5 to alkali rinse the woolen fibers 2, the temperature is raised to 40° C. and maintained at that temperature for 15 minutes, and the adhesion strength of the cationic polymer resin 15 to the woolen fibers 2 is further improved. Subsequently, the circulator 4 is stopped, the solution is removed, the woolen fibers 2 are taken out and dried with a hot air drier provided separately, and the cationic polymer resin ion bonded to the woolen fibers 2 is fixed while it covers the silk fibroin, thereby further stabilizing the adhesion of the silk fibroin and the cationic polymer resin to the woolen fibers 2.

Figure 1A:
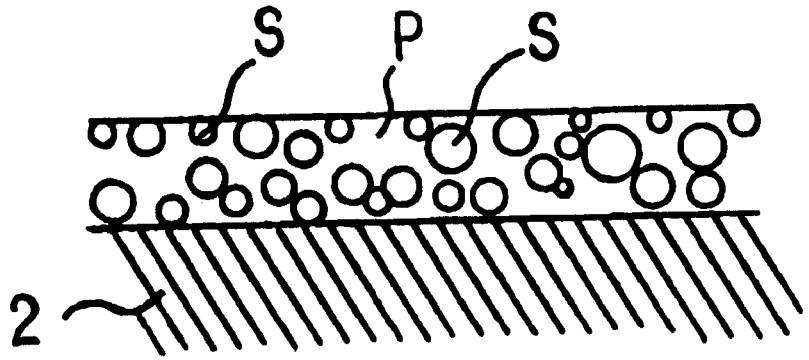
Figure 1B:
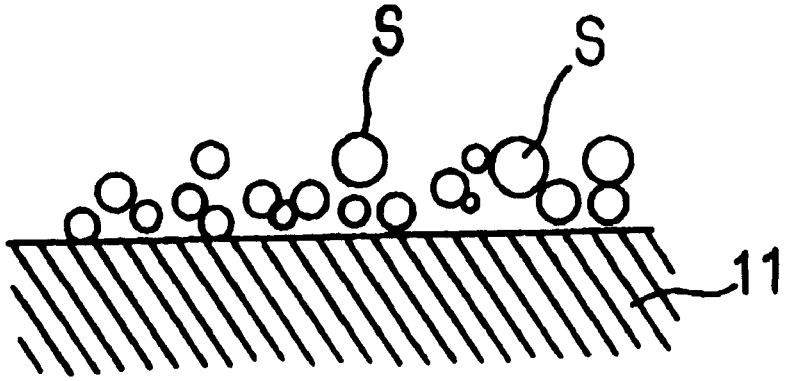

FIG. 1(*a*) is a diagram of the woolen fiber 2 subjected to the above treatment, which shows that the silk fibroin fine particles S are adhered in large quantities and uniformly to each of the woven woolen fibers 2 compared with the prior art shown in FIG. 1(*b*). Since the cationic polymer resin P is adhered to the above woolen fiber 2 in such a manner that it covers the silk fibroin fine particles S adhered to the above woolen fiber 2, the silk fibroin fine particles S hardly fall off from the woolen fiber 2.

The above woven woolen fibers 2 subjected to the above treatment are processed into yarn and then dyed, or woven into cloth and then dyed to become a fabric. Therefore, even when the silk fibroin fine particles are not uniformly adhered to the woolen fibers 2 as the woolen fibers 2 are nonuniformly charged into the cage 6 of the dyeing bath 5, the woven woolen fibers are mixed at the time of processing them into yarn, whereby the silk fibroin fine particles are almost uniformly adhered to each of the woolen fibers 2 processed into yarn or in the form of cloth and the woolen fibers 2 are not dyed nonuniformly when they are dyed.

In the above embodiment, the woven woolen fibers 2 are used. Even when the unwoven woolen fibers 1 or the reeled woolen fibers 3 are used, the silk fibroin fine particles can be adhered to the woolen fibers 1 and 3 uniformly and firmly. When the woolen fibers in the form of cloth are subjected to the above treatment, it is needless to say that woolen fibers having excellent durability to which a larger amount of silk fibroin is adhered than those of the prior art can be obtained.

In the above example, 3.0 wt % of silk fibroin and 1.0 wt % of a cationic polymer resin are used based on the total weight of the woolen fibers 2 to carry out the above treatment. However, the amount of the silk fibroin and the amount of the cationic polymer resin used for modification are not limited to these. That is, the amount of the silk fibroin and the amount of the cationic polymer resin are suitably determined according to the state of woolen fibers to be treated, the relationship between the targeted silky feeling and gloss of a modified woolen fiber and the targeted durability of the modified woolen fiber, and the like.

As having been described above, according to the production process of the present invention, a modified woolen fiber subjected to a silk fibroin treatment and a cationic polymer resin treatment has silk fibroin fine particles which are covered and fixed to the surface of the woolen fiber uniformly by the cationic polymer resin. Therefore, the modified woolen fiber has a silky feeling and gloss and improved durability.

Further, since an unwoven, woven or reeled woolen fiber having a large surface area is treated, silk fibroin is uniformly adhered to the surface of the woolen fiber and there is no lack of uniformity in dyeing.

Further, since silk fibroin can be adhered firmly and uniformly to the woolen fiber, adhered silk fibroin has sufficient durability and does not fall off from the woolen fiber when washing or the like is repeated.

What is claimed is:

1. A process for producing a modified woolen fiber comprising:

subjecting a woolen fiber to anionic processing;

infiltrating the woolen fiber with a silk fibroin solution;

dissolving a cationic polymer resin in the solution; and ion bonding the cationic polymer resin to the woolen fiber to fix silk fibroin to the woolen fiber.

2. The process for producing a modified woolen fiber according to claim 1, wherein the woolen fiber is an unwoven, woven or reeled woolen fiber.

3. A modified woolen fiber prepared by subjecting a woolen fiber to anionic processing, infiltrating the woolen fiber with a silk fibroin solution, dissolving a cationic polymer resin in the solution and ion bonding the cationic polymer resin to the woolen fiber to fix silk fibroin to the woolen fiber.

4. The modified woolen fiber according to claim 3, wherein the woolen fiber is an unwoven, woven or reeled woolen fiber.

* * * * *